US005626343A

United States Patent [19]

Sanders

[11] Patent Number: 5,626,343

[45] Date of Patent: May 6, 1997

[54] WATER TARGETING GAME

[76] Inventor: Gary M. Sanders, 355 N. Lantana #720, Camarillo, Calif. 93010

[21] Appl. No.: 688,288

[22] Filed: Jul. 29, 1996

[51] Int. Cl.[6] ..... A63F 9/02

[52] U.S. Cl. ..... 273/349; 273/371

[58] Field of Search ..... 273/349, 350, 273/378, 313, 371, 374, 348

[56] References Cited

U.S. PATENT DOCUMENTS

| | | | |
|---|---|---|---|
| 4,743,030 | 5/1988 | Auer et al. | 273/349 |
| 5,411,269 | 5/1995 | Thomas | 273/349 |
| 5,435,569 | 7/1995 | Zilliox | 273/349 |
| 5,549,303 | 8/1996 | Kastner | 273/349 |

*Primary Examiner*—Mark S. Graham
*Attorney, Agent, or Firm*—Albert O. Cota

[57] ABSTRACT

A water targeting game (10) that is preferably played within an obstruction maze known as WATER TAG ™. The game (10) consists of two major elements: a targeting vest (12) and a water gun (140). The targating vest (12) includes a front vest (14) and a back vast (16) that are joined together at their upper peripheral edge (26) by a pair of adjustable shoulder straps (70) and that are adjusted at a person's waist by a pair of waist straps (74, 76). Between the two vests is a cavity (56) and on the front section (42) of the vest, is located a plurality of water collecting openings (58) that serve as targets. When playing the game, the water gun emits a stream of water that is aimed at the openings (58) from where the water falls into the cavity (56). Between the front and back vests is attached a quick-disconnect flexible hose (96). The hose equalizes the quantity of water in both of the vests. The water collected in the cavities (56) is viewed on a scaled, vertical window that is also located on the vest's front section (42).

18 Claims, 4 Drawing Sheets

WATER TARGETING GAME

TECHNICAL FIELD

The invention pertains to the general field of water related games and more particularly to a game that utilizes a targeting vest that collects and indicates the amount of water emitted from a water gun.

BACKGROUND ART

It has been suggested that man is aggressive by nature and thus drawn to compete in competitive games and sports. For thousands of years, man has competed in combative-type games, which allow a healthy release of hostile and aggressive tendencies. In order for combative-type games to be effective, they must accurately simulate actual combat reality. Most people have a concept of combat from what is seen on television or other media. Whenever an enemy has been shot, the event is registered by the enemy falling down or otherwise becoming disabled.

Water guns and water targets have long been implements of such combative-type games. These water guns allow individuals to shoot at each other and actually register a response when an opponent has been bit. Some of today's water guns are able to accurately shoot water beyond 50 feet. Unfortunately, whenever a water gun is used without accessories little interaction occurs outside of mutual soaking. Similarly, static water targets are simple and often quickly become unchallenging.

At carnivals, water guns using pressurized water are employed to shoot at targets, actuating external devices. Targets of this type plug into electrical current receptacles and utilize mechanically actuated switching components. These components typically require high water pressure, which limits the compactness, mobility and general use of these arrangements.

The inventive water targeting game disclosed herein, includes a site of vulnerability focused upon a target. Thus, the game becomes more interesting and more fun to play. With practice, some players will find it easier to strike certain vulnerable sites than others. This difference in skills enhances the competitive nature of the game.

A search of the prior art did not disclose any patents that read directly on the claims of the instant invention however, the following U.S. patents were considered related:

| U.S. PAT. NO. | INVENTOR | ISSUED |
|---|---|---|
| 5,411,269 | Thomas | 2 May 1995 |
| 4,743,030 | Auer et al | 10 May 1988 |
| 4,363,483 | Minami | 14 December 1982 |

The 5,411,267 patent discloses a water-gun target game and apparatus in which a direct-current electrical water-presence detector, supported by or worn on an outer garment, is the target. A hit by a water jet from a water gun, initiates action by a direct electrical effect ordering responses by switching, sound or visual signaling, and scoring devices. A water-level sensor initiates a signal after a succession of hits or a strong continuous hit. An absorption option disposes received water, allowing repetitious operation. A tank for the water level sensor has a discharge stopper, which when removed, opens a power source circuit and inhibits any response. The object of the game is to project the jet stream of the water gun on to the target, making one or repetitious hits on the apparatus-bearer's bull's-eye.

The 4,743,030 patent discloses a simulated combat game set in which the players are provided with toy water guns and each player wears a target. When a gun is fired by a player it shoots out a stream of water, each player trying to hit a vulnerable site on the target worn by an opposing player and thereby strike him out. The vulnerable site on the target consists of a plaque or label having printed thereon a strike symbol or other hit indicator covered by a mask that conceals the indicator. The hit indicator is readable only when the mask is made wet and transparent by the water stream from the water gun.

The 4,363,483 patent discloses a game having a transparent housing filled with a liquid and a movable member. The member located in the liquid can be made competitive by utilizing a first and second circulating member each capable of ejecting a stream of liquid from a nozzle to move the movable member. The game incorporates a housing having two separate pivoting members. Each pivoting member is located in association with one of the nozzles and moves in response to impingement of liquid ejected from the nozzles. The ejected liquid impinges upon the surface of the pivoting members to both pivot the members and deflect the stream of liquid. The degree of pivoting and the amount of deflection are dependent on the force of ejection of the stream of liquid.

For background purposes and as indicative of the art to which the invention relates, reference may be made to the following remaining patents found in the search:

| U.S. PAT. NO. | INVENTOR | ISSUED |
|---|---|---|
| 4,040,622 | Sinnott | 9 August 1977 |
| 4,093,228 | Pierce | 6 June 1978 |
| 4,165,073 | Kellerstrass | 21 August 1979 |
| 4,526,366 | Kenoun | 2 July 1985 |
| 4,718,661 | Wolfe | 12 January 1988 |
| 5,261,873 | Bremer et al | 16 November 1993 |
| 5,263,714 | Rudell et al | 23 November 1993 |
| 5,435,569 | Zilliox | 25 July 1995 |

DISCLOSURE OF THE INVENTION

The water targeting game is designed to be played outdoors by at least two opposing players, particularly in a maze that includes walkways and obstructions. In its most basic design, the water targeting game consists of:

a) a targeting vest worn by each of two game participants. The targeting vest is further comprised of:

(1) a front vest consisting of a rear section and an attached front section, wherein between the rear and front sections is located a sealed cavity. The front section further has a plurality of water-collecting openings, a vertical sealed window, and a water inlet/outlet port having attached a quick-disconnect hose fitting, (2) a back vest identical to said front vest, means for attaching the front and back vests, (3) means for attaching the front and back vests, (4) means for allowing the front and back vests to fit snugly against a person's waist, (5) a flexible hose having on each end a fitting designed to be releasably-attached to the quick-disconnect hose fitting. The hose equalizes the water level on both the front and back vests, and b) a water gun having means for storing a quantity of water and means for creating a stream of water. The stream of water has sufficient force to strike and flow into at least one of the water-collecting openings which function as targets. The quantity of water collected is determined by viewing the level of water with reference to a multiplicity of graduated horizontal lines visible through the vertical sealed window.

The front and back vests have a peripheral edge that includes an upper edge and a lower side edge. On each side of the upper peripheral edge is located a horizontal strap slot and on each lower side of the peripheral edge is located a vertical strap slot. Through each of the horizontal slots, is inserted an adjustable shoulder strap. The strap is adjusted to allow the targeting vest to remain at a proper height and to rest comfortably on a person's shoulders. To each vertical strap slot on the front vest is attached a front waist strap and to each vertical strap slot on the back vest is attached a back waist strap. The front and back straps have means for allowing the front and back vests to be adjusted and attached to provide a snug fit around a person's waist.

To add user comfort to the worn targeting vest, a resilient section that substantially covers the outward surface of the rear section of the front and back vests is attached. Also, to enhance the utility of the game an enclosure that houses an electrical circuit may be attached to the front section of the front vest. The enclosure includes a set of output connectors that are attached via an electrical cable to a set of electrodes. The electrodes are positioned to interface with the water when the water reaches a predetermined level.

The electrical circuit includes a battery, a buzzer or light bulb, and an on-off switch. When the water makes contact with the electrodes, the water shorts the electrodes causing the electrical circuit to close and cause the buzzer to buzz or light bulb to illuminate. The person who has an illuminated bulb is considered to have expired and is out of the game.

In view of the above disclosure, it is the primary object of the invention to allow at least two persons to participate in a water targeting game that utilizes a targeting vest in combination with a water gun.

In addition to the primary object of the invention, it is also an object of the invention to provide a targeting vest that:

- o can be made to include any number of water-collecting openings which serve as targets,
- o can be manufactured in a variety of colors to differentiate one person or teams from a competing person or teams,
- o can be dimensioned to fit over a small body i.e., a child or an adult,
- o is relatively maintenance free, and
- o is cost effective from both a manufacturing and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
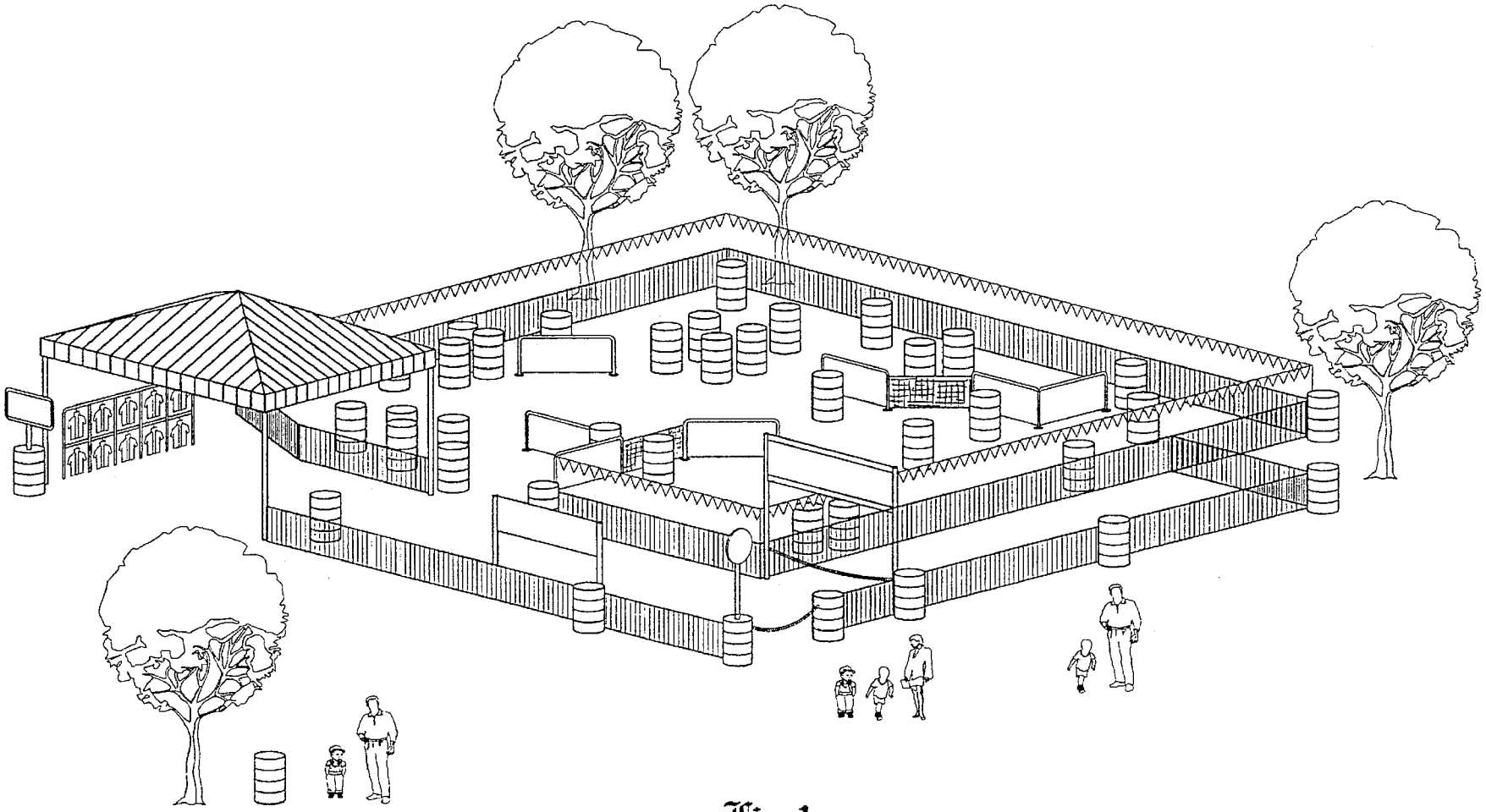
FIG. 1 is a perspective view of an obstruction maze, known as WATER TAG TM where the water targeting game is played by at least two players.

The best mode for carrying out the invention is presented in terms of a preferred embodiment that is shown in FIGS. 1–12, and that is comprised of two major elements: a targeting vest 12 and a water gun 140. The two elements are used in combination to produce a water targeting game 10, which is played in an obstruction maze known as WATER TAG ™. The obstruction maze, as shown in FIG. 1, consists of a fenced area having several obstructions movably located within. One of the obstructions is a water source from where the water gun 140 can be filled to commence and continue the play. The WATER TAG™ game is played with at least two game participants, however, teams of two or more players can also participate in the game.

Figure 2:
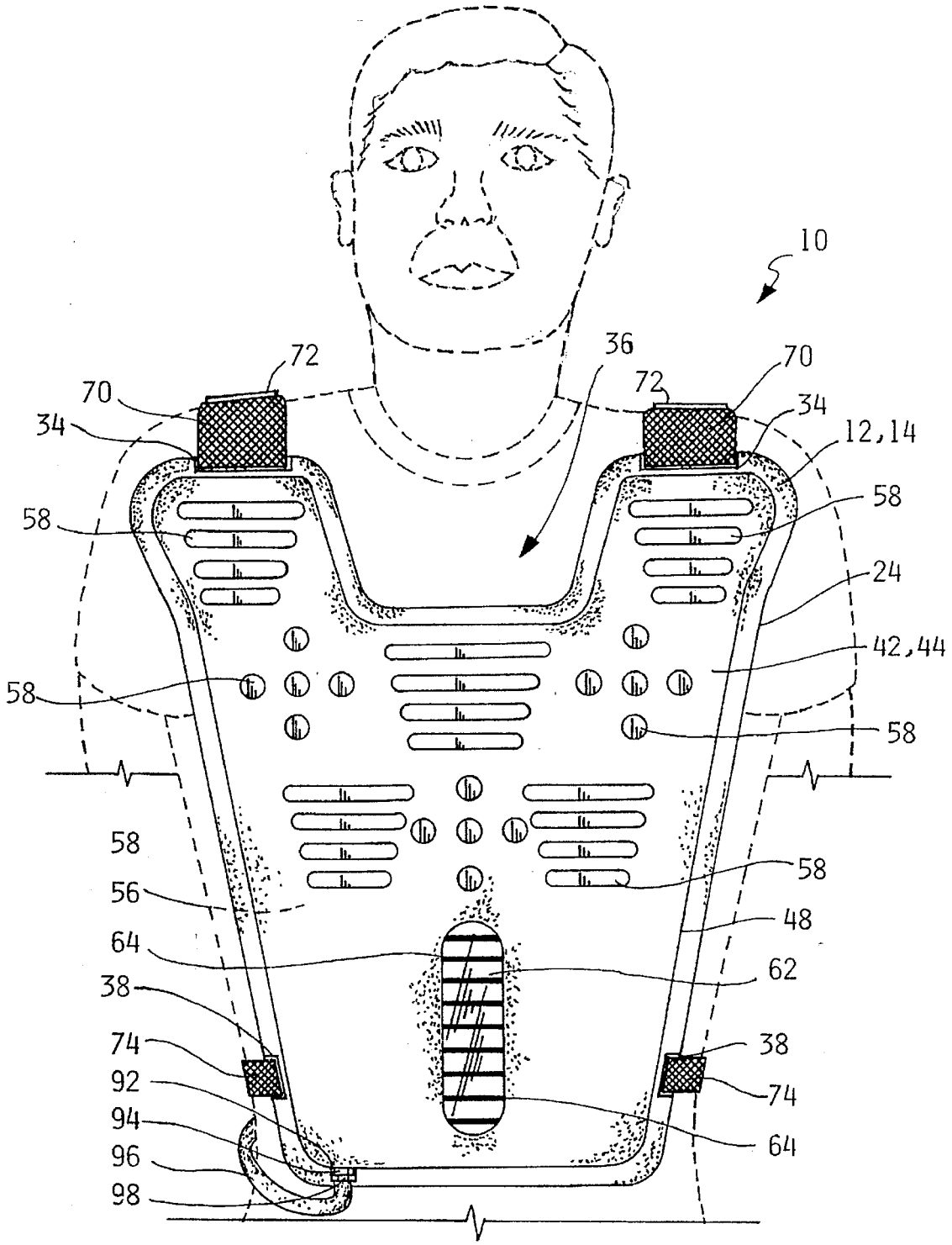
FIG. 2 is an elevational view of the front section of the targeting vest. The vest is shown as would be worn by a game participant.

The targeting vest 12, as shown attached to a person in FIG. 2, consists of two identical vests designated as a front vest 14 and a back vest 16. Since the two vests are identical, reference is made to only the front vest 14, which is shown in FIGS. 2–5.

The front vest 14, which may be constructed of cloth, canvas or preferably a water repellant material such as plastic, is further comprised of a rear section 18 and a front section 42.

Figure 3:
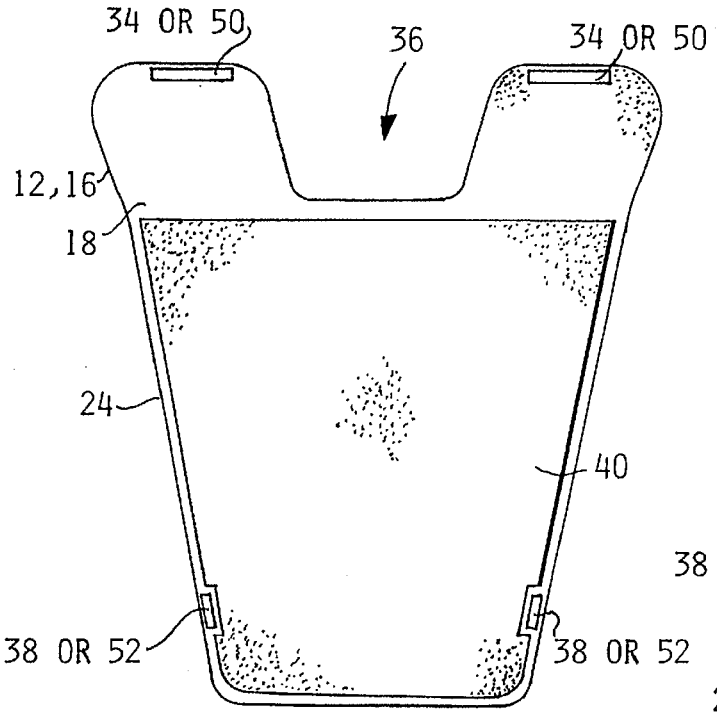
FIG. 3 is an elevational view of the Fear section of the targeting vest.
Figure 4:
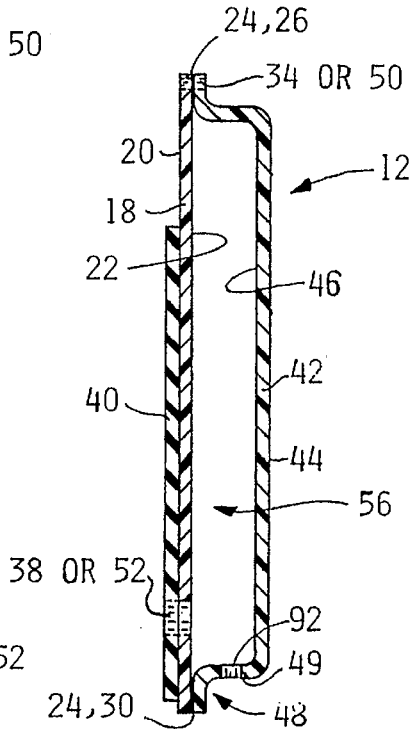
FIG. 4 is an elevational side-sectional view of the targeting vest.
Figure 5:
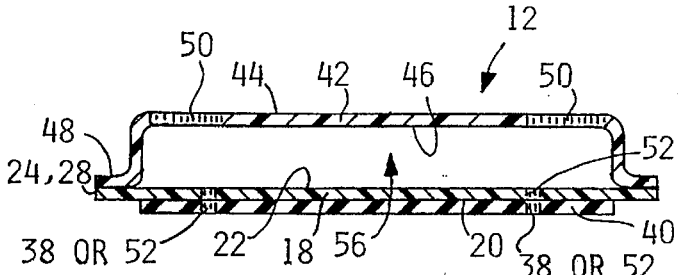
FIG. 5 is a plan-sectional view of the targeting vest.

The rear section 18, as shown in FIGS. 3, 4 and 5 has an outward surface 20, an inner surface 22 and a continuous peripheral edge 24 that includes upper 26, side 28 and lower 30 edges, on each side of the upper peripheral edge 26 is located a horizontal strap slot 34, 50 as best shown in FIGS. 2 and 3. Between the two slots 34, 50 is a substantially centered head opening 36, as also shown in FIGS. 2 and 3, that is dimensioned to accommodate any normal sized head and shoulders. On the side peripheral edge 28 near its lower terminus is located a vertical strap slot 38, as shown in FIGS. 2 and 3. In the preferred embodiment, as shown in FIGS. 3, 4 and 5, there is included a resilient section 40. The section 40 substantially covers and is attached, by an attachment means, to the outward surface 20 of the rear section 18 of the front vest 14 and back vest 16. The section 40 consists of a bonded, inner cushioned layer that provides comfort to the wearer of the targeting vest 12.

The front section 42 of the targeting vest 12 has an outward surface 44, an inner surface 46 and a continuous inward and outward extending tab 48, as best shown in FIGS. 3–5. The tab 48 is integrally molded adjacent the peripheral edge 24 of the reap section 18, as shown in FIGS.

4 and 5. The front section 42 also includes a pair of horizontal strap slots 50 and a pair of vertical strap slots 52 that are in alignment with the respective horizontal and vertical strap slots 34, 38 on the rear section 18. As shown in FIGS. 4 4 and 5, between the inner surfaces 22, 46, is located an edge sealed cavity 56 that functions as a water collecting area as described infra.

On the front section 42 of the targeting vest 12, as shown in FIG. 2, is located a plurality of water-collecting openings 68 which substantially encompass the upper two-thirds of the front section 42. As best shown in FIG. 2, the openings are preferably symmetrically located and consist of horizontal and circular patterns. However, any configuration of patterns can be utilized.

Figure 6:
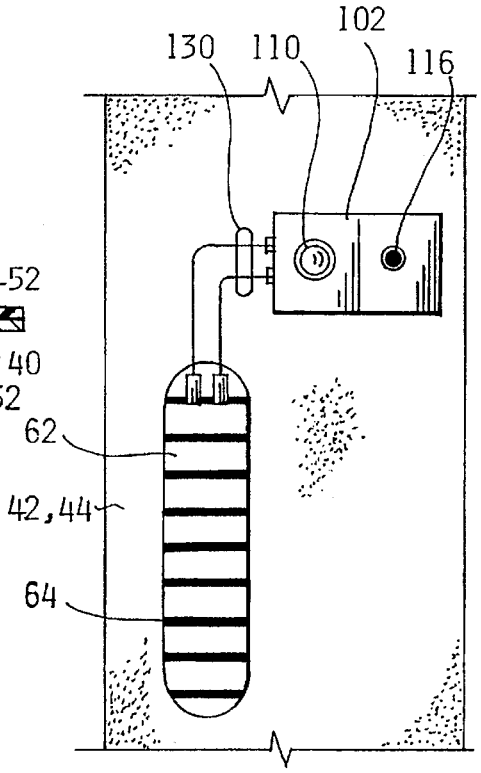
FIG. 6 is an elevational view showing the vertical sealed window with graduated horizontal lines, and an attached enclosure that houses an electrical circuit that includes a pair of electrodes attached to the upper end of the window by means of a cable.

Located below the openings 58 is located a sealed vertical window 62, as shown in FIGS. 2 and 6, that is substantially centered on the lower one-third of the front section 42. Through the window 62 can be viewed a multiplicity of graduated horizontal lines 64. These lines 64 can be printed on the back side of the vertical sealed window 62, Of preferably, the lines 64 are printed on the inner surface 22 of the rear section 18 in alignment with the window 62. When the lines are printed on the inner surface 22, the limes are magnified by the water which allows a game participant to easily see the water-level status of an opposing game player.

Figure 7:
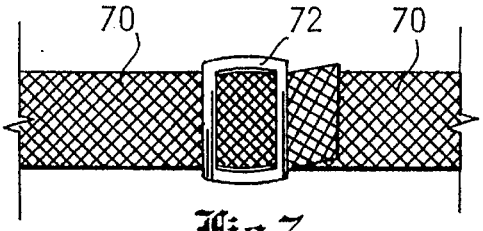
FIG. 7 is an plan view of a shoulder strap that includes a slip-through adjustable buckle.

The targeting vest 12, as previously discussed, consists of the front vest 14 and the back vest 16. To secure the front vest to the back vest, a pair of shoulder straps 70 are utilized. The shoulder straps 70 are inserted through the horizontal strap slots 34, 50 located respectively on the front and back vests 14, 16. The shoulder straps 70 include an adjusting means that allows the front and rear vests to be adjusted and attached to remain at a proper height and to rest comfortably upon a person's shoulder. The preferred adjusting means consists of a slip-through adjustable buckle 72, as shown in FIG. 7.

To allow the front vest 14 and the back vest 16 to be adjusted and attached smugly to a person's waist, a front waist strap 7*a* and a back waist strap 76 are utilized. The front waist strap 74 is attached to each vertical strap slot 38 on the front vest 14 and a back waist strap 76 is attached to each vertical strap slot 52 on the back vest 16.

Figure 8:
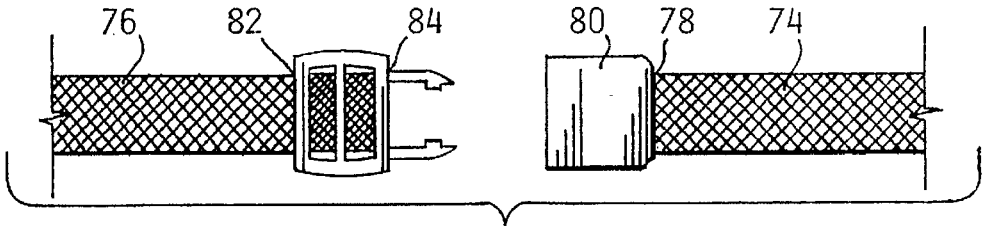
FIG. 8 is an elevational view of the front and back waist straps shown respectively with a slotted buckle receptor and a resilient two-prong buckle.
Figure 9:
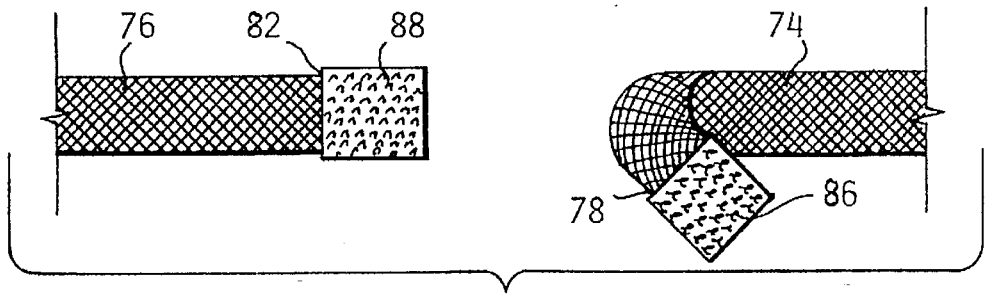
FIG. 9 is an elevational view of the front and back waist straps shown respectively with a hook section and loop section.

The waist straps have a means to allow the front and back vests 14, 16 to be attached filter the strap length is sat. Two such means are disclosed: in the first attachment means, as shown in FIG. 8, the front waist straps 74 have an outer end 78 that has attached a slotted buckle receptor 80. Likewise, the back waist strap 76 has an outer and 82 that has attached a resilient two-prong buckle 8*a*. When the buckle 84 is inserted into the receptor 80 it automatically engages the buckle receptor 80. In the second attachment means, as shown in FIG. 9, the front waist straps 74 have an outer end 78 that have attached a hook section 86 of a hook and loop fastener. Likewise, the back waist strap 76 has an outer end 82 that has attached a loop section 88 of a hook and loop fastener. When the hook and loop sections 86, 88 are pressed together, the two straps are fastened.

Figure 10:
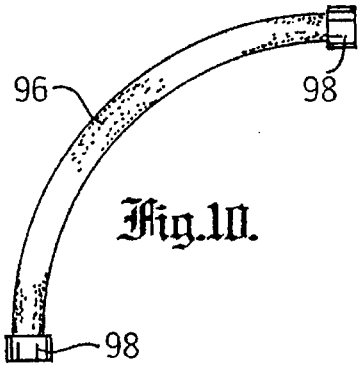
FIG. 10 is an elevational view of a flexible hose that is used to connect the front vest to the back vest.

On the lower inward section 49 of the inward and outward tab 48 on the front vest 14 and back vest 16, as shown in FIGS. 2 and 4, is located a water inlet/outlet port 92. To the ports 92 is attached a quick-disconnect hose fitting 94, as shown in FIG. 2, which seals the port 92. To the fittings 94 is attached a flexible hose 96, as shown in FIG. 10, having on each end a fitting 98 designed to be releasably-attached to the quick-disconnect hose fittings 94. The flexible hose 96, which is preferably corrugated, allows the water level in both the front vest 14 and back vest 16 to be equalized. Thus, the water level that is viewed and indicated on the vertical sealed window 62 is indicative of the water level on both the front and back vests 14, 16. Various hose lengths are provided to accommodate the various waist sizes of game participants.

When the WATER TAG™ is played, the edge sealed cavity 56 will be eventually filled with water. Therefore, a means must be provided to release the water from the cavity 56 at the conclusion of a game period. To accomplish this water release, the vests are turned upside-down to allow the water to drain through the plurality of water-collecting openings 58 The hose 96 may also be disconnected at the end of a game period to release the water in the cavity 56 through the ports 92.

Figure 11:
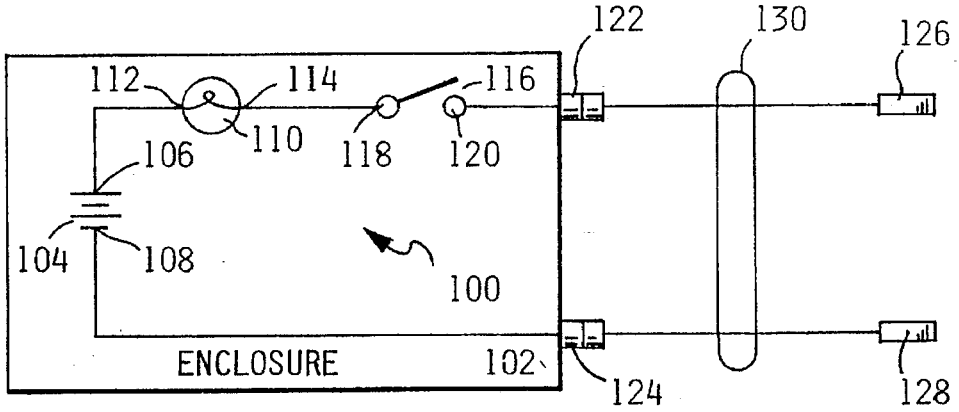
FIG. 11 is a schematic diagram of the electrical circuit that allows a light bulb to illuminate when a game is over.

The targeting game 10 can be initiated and completed with the elements as described above. However, to add and enhance the utility of the game, an electrical circuit 100 may be added. The electrical circuit, as shown in FIG. 11, is enclosed in a water tight enclosure 102 that is attached to the outward surface 44 of front section 42 of the front vest 14 near the vertical sealed window 62, as shown in FIG. 6. The electrical circuit 100, is comprised of a battery 104 having a positive terminal 106 and a negative terminal 108, a buzzer 110 or a light bulb 110 having a first terminal 112 and a second terminal 114; a single-pole, double-throw switch 116 having a first terminal 118 and a second terminal 120; a first output connector 122; a second output connector 124; a first electrode 126; a second electrode 128; and an electrical cable 130.

The electrical circuit path is as follows: the first terminal 112 of the light bulb 110 is connected to the positive terminal 106 of the battery. The light bulb's second terminal 114 is connected to the first terminal 118 of the switch 116. The second terminal 120 of the switch 116 is connected to the first output connector 122. The second output connector 124 is connected to the negative terminal 108 of the battery 104 to complete the electrical circuit 100. The first and second output connectors 122, 124 are connected to the first and second electrodes 126, 128 by means of the cable 130, as shown in FIG. 11. When the water level in the cavity makes contact with the electrodes 126, 128, the water shorts the electrodes which in turn, causes the electrical circuit to close and cause the buzzer 110 to buzz or the light bulb 110 to illuminate indicating that the person with the buzzing sound or illuminated bulb has expired and is out of the game.

Figure 12:
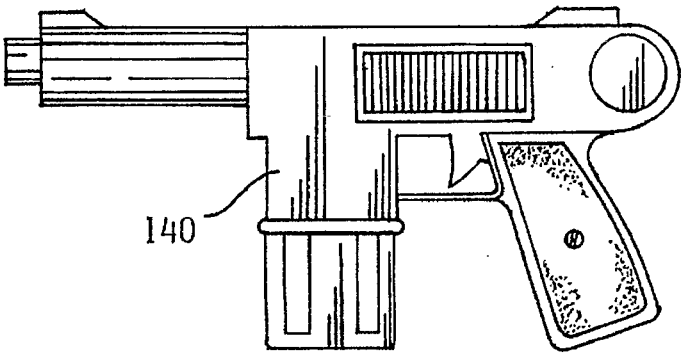
FIG. 12 is a perspective view of a typical water gun.

The second and final element that comprises the WATER TAG™ is the water gun 140. The gun, as shown in FIG. 12, can be of any shape and size as long as it has means for containing a quantity of water and a means for creating a stream of water of sufficient force. The force should be such that the stream of water can reach a water collecting opening 58, which serves as a target, at a distance of at least 8 feet.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A water targeting game comprising:

a) a targeting vest comprising:

(1) a front vest comprised of a rear section and an attached front section, wherein between the rear and front sections is located a sealed cavity, with the front section further having a plurality of water-collecting openings, a vertical sealed window, and a water inlet/outlet port having attached a quick-disconnect hose fitting, (2) a back vest identical to said front vest, (3) means for adjusting and attaching said front and back vests, (4) means for allowing said front and back vests to fit snugly against a person's waist, (5) a flexible hose having on each end a fitting designed to be releasably-attached to said quick-disconnect hose fitting, and b) a water gun having means for storing a quantity of water and means for creating a stream of water having sufficient force to strike and flow into at least one of said water-collecting openings, wherein the quantity of water collected is determined by viewing the level of water visible through said vertical sealed window.

2. The water targeting game as specified in claim 1 further comprising a resilient section that substantially covers and is attached, by an attachment means, to an outward surface of the rear section of said front and back vests.

3. The water targeting game as specified in claim 1 wherein said means for attaching said front and back vests comprises:

a) said front and back vests having an upper peripheral edge with two sides further having on each side a horizontal strap slot, and b) a shoulder strap inserted through the respective horizontal strap slots, wherein said shoulder straps having an adjusting means.

4. The water targeting game as specified in claim 1 wherein said means for snugly fitting said front and back vests to a person's waist comprises:

a) said front and back vests having side peripheral edges further having on each side a vertical strap slot, and b) a front waist strap attached to each vertical strap slot on said front vest, and a back waist strap attached to each vertical strap slot on said back vest, wherein said front and back straps have means for allowing said front and back vests to be adjusted and attached.

5. The water targeting game as specified in claim 2 wherein said resilient section is comprised of a bonded, inner cushioned layer.

6. The water targeting game as specified in claim 1 wherein said plurality of water-collecting openings are symmetrically located and consist of horizontal and circular patterns.

7. The water targeting game as specified in claim further comprising a multiplicity of graduated horizontal lines printed on an inner surface of the rear section of said back vest in alignment with said vertical sealed window.

8. A water targeting game comprising:

A. a targeting vest worn by each of at least two game participants, wherein said targeting vest further comprises:

a) a front vest comprising:

(1) a rear section having an outward surface, an inner surface and a continuous upper, side, and lower peripheral edge, including a pair of upper peripheral side edges with each side of the upper peripheral edge having a horizontal strap slot, and including a pair of side peripheral edges with each side peripheral edge having a vertical strap slot, (2) a front section having:

(a) as outward surface, an inner surface and a continuous inward and outward extending tab integrally molded adjacent the peripheral edge of said rear section, with said front section having a pair of horizontal and vertical strap slots in alignment with the horizontal and vertical strap slots on said rear section, and wherein between the inner surfaces of said rear section and said front section is located an edge sealed cavity, (b) a plurality of water-collecting openings located around an area that substantially encompasses the upper two thirds of said front section, (c) a sealed vertical window substantially centered on the lower one-third of said front section, (d) a water inlet/outlet port located on the lower, inward section) of the inward and outward extending tab, b) a back vest identical to said front vest, c) a shoulder strap inserted through the respective horizontal strap slots located on said front and back vests, wherein said shoulder straps have an adjusting means that allows said front and rear vests to be attached and adjusted for height and to comfortably rest upon a person's shoulders, d) a front waist strap attached to each vertical strap slot on said front vest, and a back waist strap attached to each vertical strap slot on said back vest, wherein said front and back waist straps having means for allowing said front and back vests to be attached and adjusted to fit snugly against the person's waist, e) a quick-disconnect hose fitting attached to said water inlet/outlet ports on said front vest and said back vest, and f) a flexible hose having on each end a fitting designed to be releasably-attached to said quick disconnect hose fittings, and B. a water gun having means for storing a quantity of water and means for creating a stream of water having sufficient force to strike and flow into at least one of said water-collecting openings, wherein the quantity of water collected is determined by viewing the level of water with reference to a multiplicity of graduated horizontal lines visible through said vertical sealed window.

9. The water targeting game as specified in claim 8 further comprising a resilient section that is attached, by an attachment means, to the outward surface of the rear section of said front and back vests.

10. The water targeting game as specified in claim 9 wherein said rear resilient section is comprised of a bonded, inner cushioned layer.

11. The water targeting game as specified in claim 8 wherein said plurality of water-collecting openings are symmetrically located and consist of horizontal and circular patterns.

12. The water targeting game as specified in claim 8 wherein said multiplicity of graduated horizontal lines are printed on a backside of said vertical sealed window.

13. The water targeting game as specified in claim 8 wherein said multiplicity of graduated horizontal lines are printed on the inner surface of said rear section in alignment with said vertical sealed window.

14. The water targeting game as specified in claim 8 wherein said means for adjusting and attaching said shoulder straps comprises a slip-through adjustable buckle.

15. The water targeting means as specified in claim 8 wherein said means for allowing said front and back waist straps to be attached and adjusted comprises:

a) said front waist straps having an outer end that has attached, a slotted buckle receptor, and b) said back waist straps having an outer end that has attached, a resilient two-prong buckle that when inserted into said receptor automatically engages the buckle receptor.

16. The water targeting game as specified in claim 8 wherein said means for allowing said front and back waist straps to be adjusted and attached comprises:

a) said front waist straps having an outer end that has attached, a hook section of a hook and loop fastener, and b) said back waist straps having an outer end that has attached, a loop section of a hook and loop fastener, wherein when the hook and loop sections are pressed together, said straps are fastened.

17. The water targeting game as specified in claim 8 wherein said flexible hose is corrugated.

18. The water targeting game as specified in claim 8 wherein the front section of said front vest further comprises:

a) a water tight enclosure attached thereto, wherein said enclosure houses an electrical circuit comprising:

1) a battery having a positive terminal and a negative terminal, 2) a light bulb having a first terminal and a second terminal, wherein the first terminal is connected to the positive terminal of said battery, 3) a single-pole single-throw switch having a first terminal and a second terminal, wherein the first terminal is connected to the second terminal of said light bulb and the second terminal of said switch is connected to a first output connector projecting from said enclosure, and 4) a second output connector projecting from said enclosure and connected to the negative terminal of said battery, b) a first and second electrode attached to the front section of said front targeting vest at a location where said electrodes interface with the water when the water reaches a level corresponding to an upper horizontal line on said sealed vertical window, and c) a electrical cable that interconnects the first and second electrodes with the first and second output connectors on said enclosure, whereupon when the water level makes contact with said first and second electrodes, the water shorts said electrodes causing said electrical circuit to close and causing said light bulb to illuminated.

* * * * *